US005669425A

United States Patent [19]

Verlato

[11] Patent Number: 5,669,425

[45] Date of Patent: Sep. 23, 1997

[54] ROTATING PLIERS FOR FASTENING THE REINFORCEMENT RODS OF AN ARMATURE IN THE BUILDING INDUSTRY INVOLVING CONCRETE CASTING

[76] Inventor: Giuseppe Verlato, Via Firenze, 151, Altavilla Vicentina (Vicenza), Italy

[21] Appl. No.: 601,134

[22] Filed: Feb. 14, 1996

[30] Foreign Application Priority Data

Feb. 20, 1995 [IT] Italy ..... VI95A0029
Jul. 31, 1995 [IT] Italy ..... VI95A0129

[51] Int. Cl.[6] ..... B21F 15/04

[52] U.S. Cl. ..... 140/119; 140/118

[58] Field of Search ..... 140/53, 54, 57, 140/93.4, 93.6, 118, 119, 121, 149; 30/193; 81/329, 330, 331, 332, 333

[56] References Cited

U.S. PATENT DOCUMENTS 3,092,152 6/1963 Neff ..... 140/119
5,501,251 3/1996 Vader et al. ..... 140/119

FOREIGN PATENT DOCUMENTS 2 352 637 1/1978 France ..... 140/119

*Primary Examiner*—Lowell A. Larson
*Attorney, Agent, or Firm*—Bucknam and Archer

[57] ABSTRACT

The rotating pliers has an arm (1) provided at the extremity with a screw having a long pitch (2), a sleeve (3) which rotates on the screw (2). The pliers rotate when the sleeve (3) is grasped after the pliers have been closed by means of jaws (4) and (5). The pliers rotate on the fastening thread (6) of the armature (7) after the motion of lever (11). This lever is provided at the opposite extremity with pin (12). The latter slides in the shaped groove (13). In this manner, the fastening thread (6) is grasped and is caused to rotate by traction applied to sleeve (3) and it is not necessary to cause the rotation of the pliers by hand and substantial reduction of the physical work by the operator is achieved.

2 Claims, 7 Drawing Sheets

ROTATING PLIERS FOR FASTENING THE REINFORCEMENT RODS OF AN ARMATURE IN THE BUILDING INDUSTRY INVOLVING CONCRETE CASTING

FIELD OF THE INVENTION

The present invention has the object of providing a rotating pliers capable of facilitating the fastening of the reinforcement rods of the armature in the building industry and also capable of cutting the thread after the thread has been fastened.

BACKGROUND OF THE INVENTION

It is known that the rods intended to form the armatures of the reinforced concrete casting in the building industry must be fastened among themselves in order to maintain the position which has been assumed prior to carrying out the insertion of the concrete. These fastening operations require a substantial amount of manpower, a fact which is well known to all the operators in this field because it involves many hours of work and substantial fatigue which constitutes stress for the operators.

SUMMARY OF THE INVENTION

An object of the rotating pliers of the present invention is to substantially reduce the fatigue of the operator because the operator does not have to provide the pliers to rotate in order to twist the fastening thread prior to cutting the thread.

The apparatus of the present invention is provided along one of the two handles with a threading capable to be rotated by means of a suitable sleeve, the latter being provided with suitable balls, the sleeve being simply drawn by the operator after the fastening thread has been grasped by the pliers.

A suitable lever predisposed on the opposite arm of the pliers and which engages a suitably shaped groove by means of a pawl, the groove being formed in the opposite arm, allows the pliers to remain closed to the desired pressure without cutting the rod during the operation of rotation of the same. By grasping with a hand, both arms of the pliers, it is possible to provide for the cutting of the thread after the rotation has been carried out.

It is also provided to predispose a sealing screw mounted on an eccentric structure, which has a regulatable position in order to determine the stop position of the pliers on the basis of the thickness of the fastening thread, thus blocking the position to the desired value, a position which will then be maintained up to the point when the features of the fastening thread to be twisted and to be cut, are modified.

According to a partial modification of the embodiment described hereinabove, it is provided that the blocking mechanism of the pliers is blocked by means of a shaped lamina which becomes hooked with the opposite lever of the pliers to block the pliers. Obviously, the shaped lamina may rotate and in its turn, is fixed to the opposite handle of the pliers, that is the handle provided with the maneuvering screw, while a spiral spring mounted on the rotation pin of the lamina, allows to maintain the lamina enlarged in such a manner then it remains open when it is necessary to maneuver the pliers.

According to another novel feature of the invention, it is provided that the thread necessary for blocking the reinforcing rods of the armature is contained in a suitable container to be fixed to the maneuvering lever of the pliers, the lever being opposite to the lever of the maneuvering screw, while, however, the container could be easily dismounted when it could be an incumbrance in the maneuvering of the pliers in determined positions of the work.

It is also provided to form a container for the thread by means of a simple bobbin mounted on a suitable reel, the reel being held by a stirrup which rotates on a pin fixed to the maneuvering lever of the pliers, also the container being dismountable, if necessary.

According to still another novel feature of the invention, it is provided that the threads necessary for carrying out the fastening of the reinforcing rods, both in a single, as well as in a double form, be kept in suitable means to be applied to the leg or to the middle part of the body or to the arm of the operator, to be easily removed when in use.

It should also be noted that the rotating pliers of the present invention is of such a shape that it can be handled by the operator with only one hand.

This and other features of the pliers of the invention will be more visible in the accompanying drawings of which:

Figure 1:
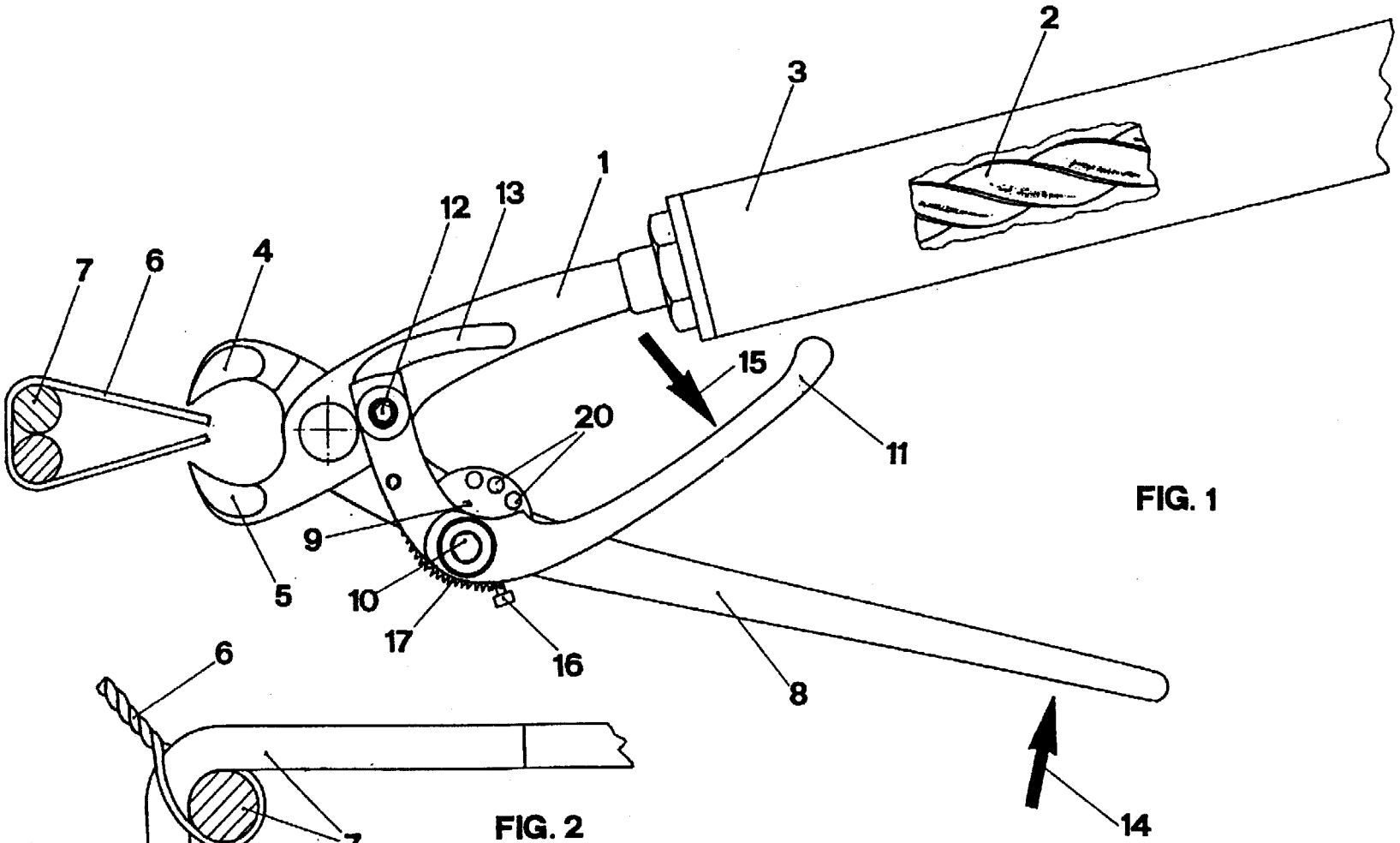
FIG. 1 is a view of the pliers according to a first embodiment of the invention in the open position.
Figure 2:
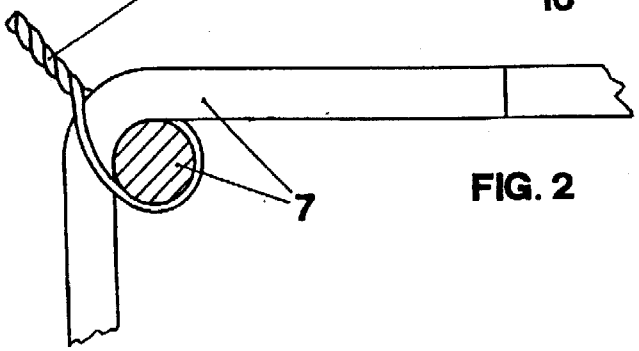
FIG. 2 illustrates a particular portion related to fastening of the threads of the armature of a beam.

As shown in FIG. 1, the rotating pliers of the present invention comprises an arm 1 provided with a screw 2 of long pitch left or right, the screw being disposed in the interior of sleeve 3. The latter is provided with balls, the balls being held by a grooved flange according to a known arrangement. The sleeve is pulled in order to allow the rotation of the pliers.

Numerals 4 and 5 designate the jaws of the pliers and they provide for grasping the thread 6 which is used for the fastening of the armature 7 in order to twist the armature around the stirrup, the latter allowing the passing of the armature. The jaws also provide for cutting the wire as it will be explained in more detail hereinbelow.

Numeral 8 designates the other arm of the pliers. An eccentric element 9 is mounted on the arm 8, the eccentric element bearing pin 10 on which the mobile maneuvering lever 11 is mounted. The lever 11 carries pin 12 on the opposite side. Pin 12 emerges with a movable tip within the shaped groove 13 which is formed on the arm 1 of the pliers. The pliers are closed manually acting in the direction of arrow 14 on the arm 8 and causing the lever 11 to rotate successively in the direction of arrow 15 so that the pin 12 is caused to move in groove 13 as shown in FIGS. 3 and 4.

Screw 16 is provided with spring 17 and determines the position of the eccentric element 9, this position being regulatable on the basis of the thickness and the properties of the thread 6 which has to be twisted and cut.

Figure 3:
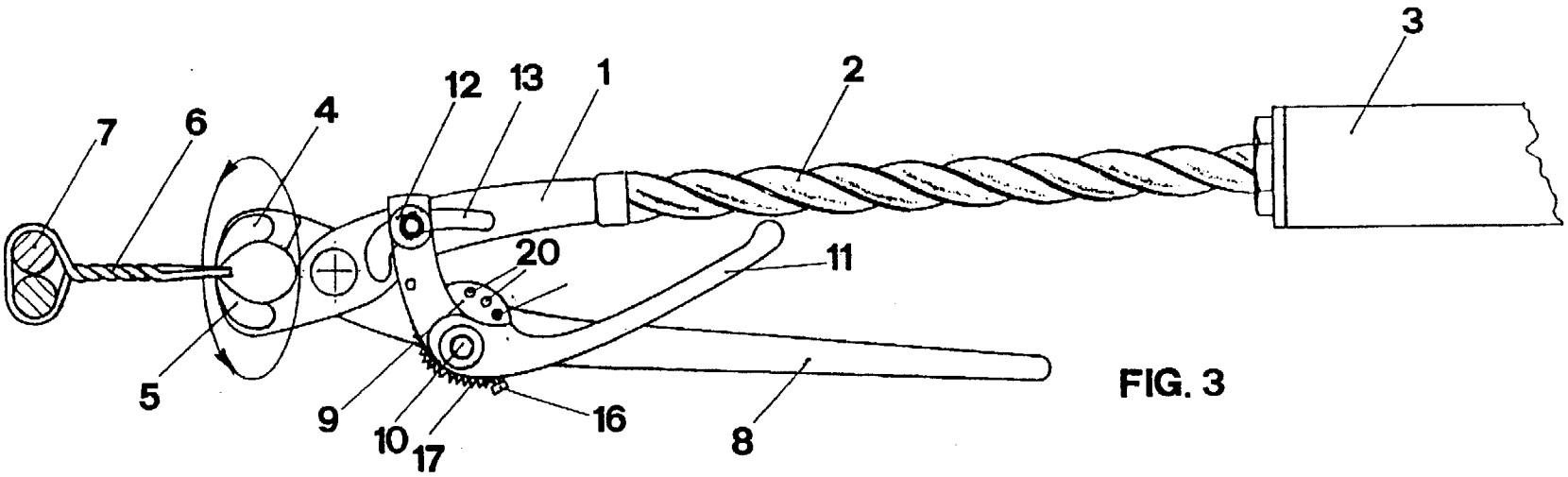
FIG. 3 illustrates the pliers at the end of the rotation of the fastening thread.
Figure 4:
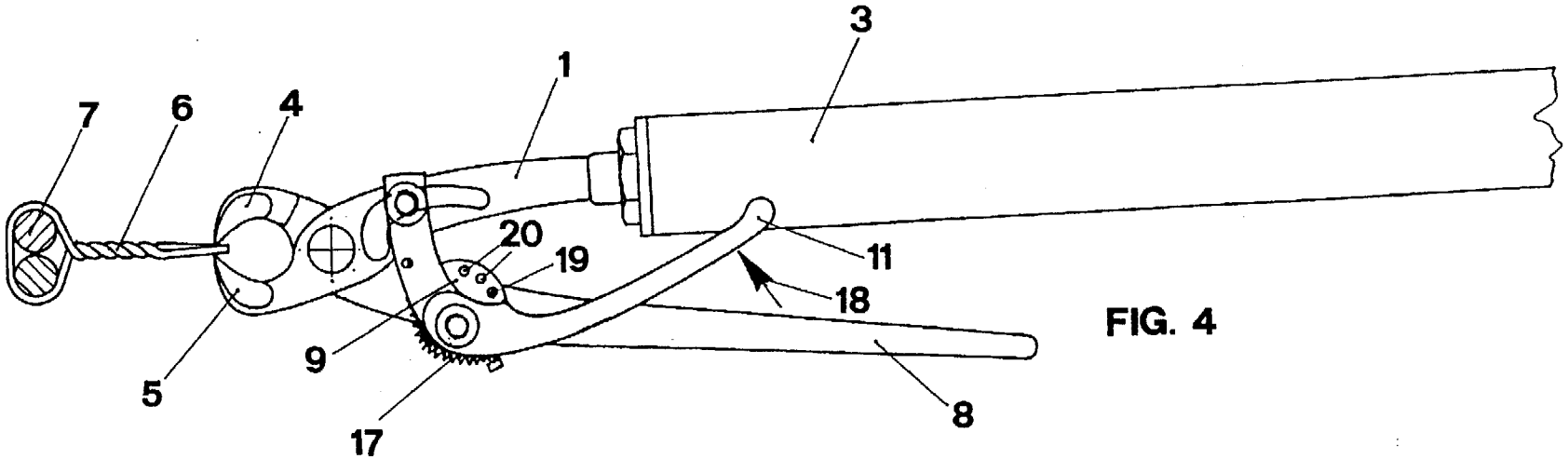
FIG. 4 illustrates the pliers at the time when the fastening thread is being cut.

In the position shown in FIG. 3, the sleeve 3 has been pulled rearwardly thus causing the rotation of the screw 2 and the arm 1, as well as the two jaws 4 and 5. This brings about the formation of a few turns of the thread 6 prior to the cutting stage. FIG. 4 illustrates the cutting of the thread which is carried out by compressing arm 8 against sleeve 3, the sleeve having been previously brought back in the initial position by applying a pushing force on the lever 11 in the direction of arrow 18.

The eccentric disc 9 is mounted on pin 10 which emerges from the maneuvering lever 11. This eccentric disc 9 is fixed in the desired position by means of a screw 19 shown in FIG. 4. Screw 19 acts on one of the orifices 20 while spring 17 exerts a return action on the eccentric disc, spring 17 being hooked to the screw 16, the return action being on the basis of the properties of dimensions or rigidity of the fastening thread 6.

Figure 5:
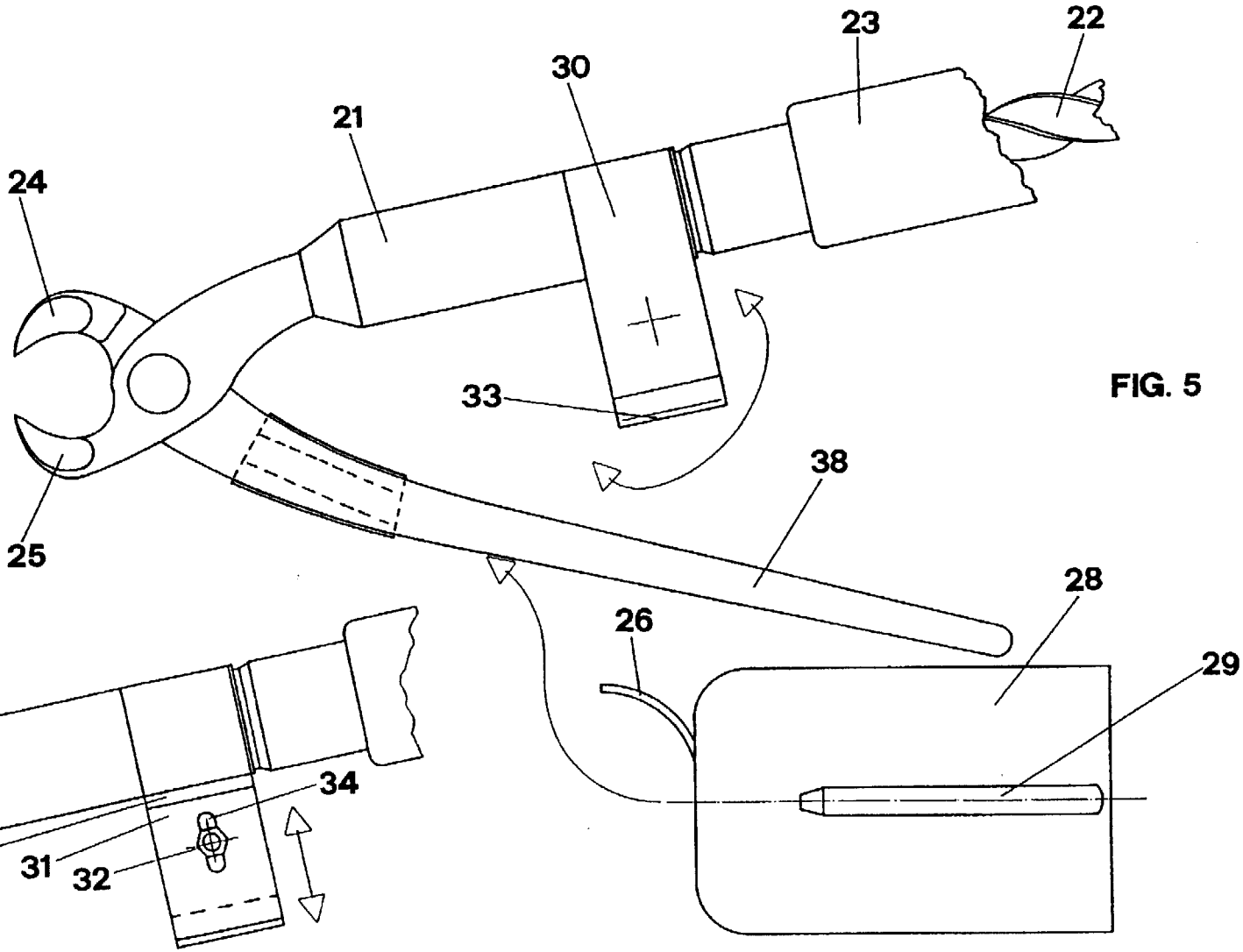
FIG. 5 illustrates a second embodiment of the pliers of the present in the open position.
Figure 7:
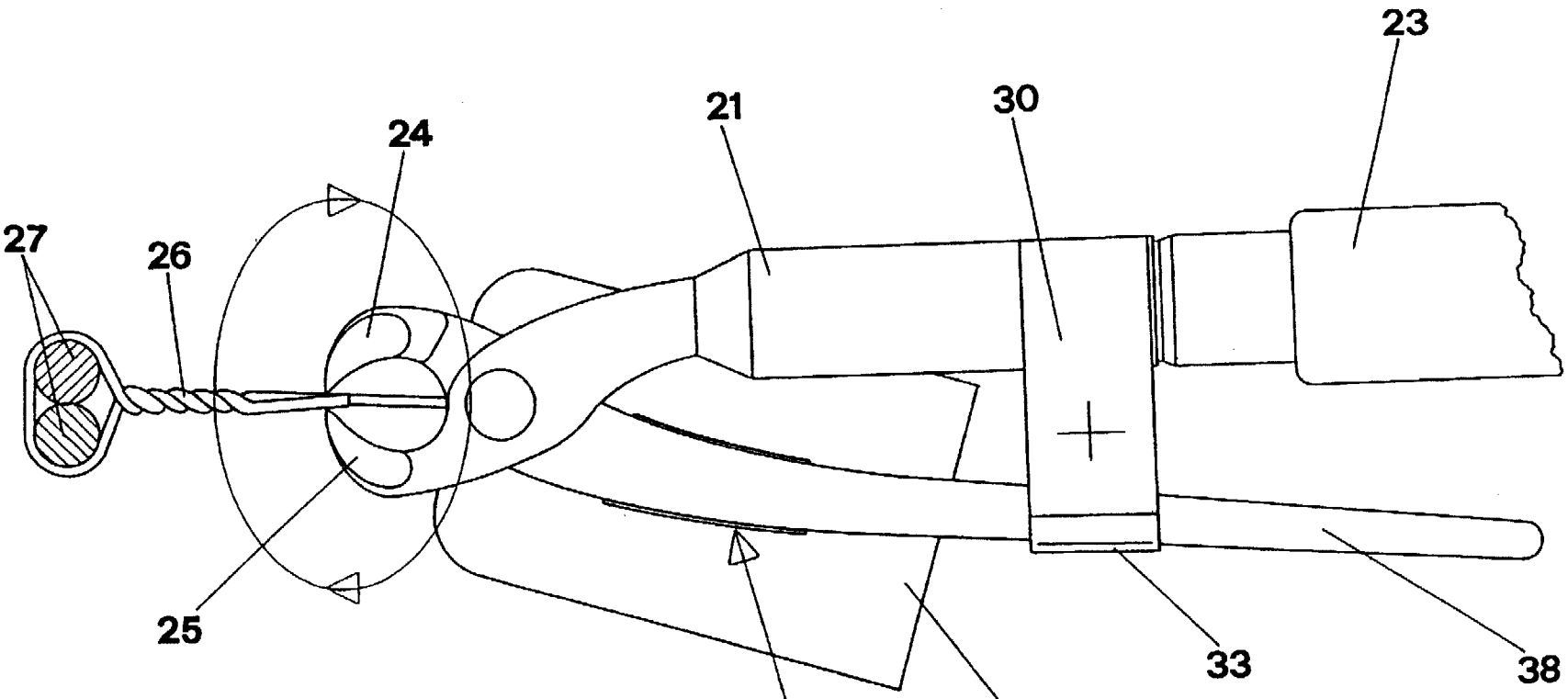
FIG. 7 illustrates the pliers according to the embodiment of FIG. 5 in the closed position.

As shown in the embodiment according to FIGS. 5 and 7, the pliers comprise a first arm 21 provided with a screw having long pitch 22. Sleeve 23 rotates on screw 22. By grasping sleeve 23, it is possible to cause the pliers to rotate while the second arm 38 of the pliers serves the function of maneuvering the pliers in the closure position by causing the jaws 24 and 25 to cut the fastening thread 26, the thread surrounding the reinforcing rods of the armature 27.

The thread 26 is removed from the bobbin contained within the container 28, the latter being fixed to the arm 38 of the pliers through pin 29, the container being easily dismantlable if necessary.

A novel feature of the pliers resides in the use of suitable lamina 30 which is disposed on the arm 21 and which allows the pliers to close on the thread 26 so that the operator may twist the thread as shown in FIG. 7 prior to cutting finally the thread through a maneuvering of greater clamping of the arm 38 through a maneuvering of greater clamping of the lever 38 at the end of the operation.

Obviously, the lamina 30 is provided with a folding 33 in its free extremity, this folding being formed on the lamina element 31 which is fixed to the lamina 30 by means of the bolt with nut 32. The bolt with nut 32 is movable within the orifice 34 shown in FIG. 6 to allow hooking of the arm 38 of the pliers.

Figure 6:
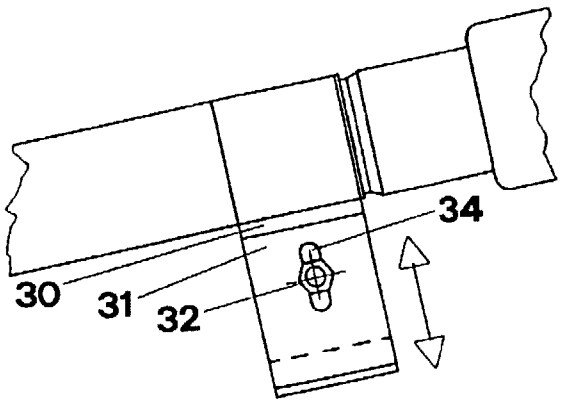
FIG. 6 illustrates a view on the opposite side of the closure lamina of the pliers.

The lamina 30, being elastic, holds firmly the pliers in the closed position when necessary, while at the time of the cut of the thread 26 returns to the free position through the presence of a return spring not shown in FIG. 6.

The bolt 32 permits to displace vertically the position of the portion 33 of the lamina 30 which has been folded, the displacement being on the basis of the thickness of the threads 26 which must be twisted and cut.

Figure 8:
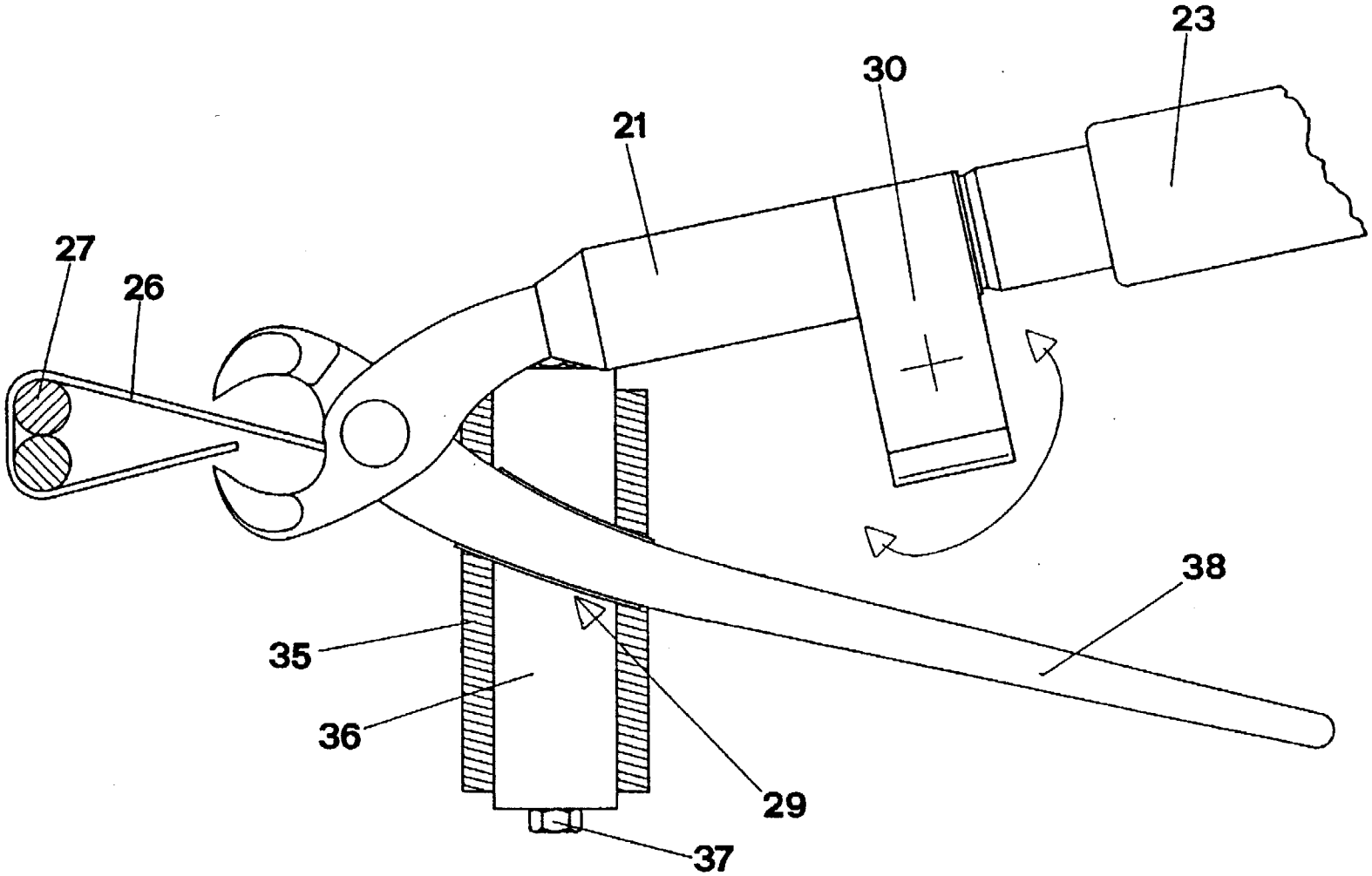
FIG. 8 illustrates the pliers in the open position with a reel of thread of different properties.

In the embodiment shown in FIG. 8, the thread 26 which fastens the reinforcing rods 27, is unwound from bobbin 35, the latter being mounted on a stirrup 36 having a double fold, through pin 37, the stirrup in turn being fixed through a pin at the arm 38 of the pliers. This alternative embodiment allows the thread 26 to be externally wrapped on the axis mounted on pin 37. This solution is different from the embodiment of FIGS. 5 and 7 in which the thread 26 is contained in the interior of container 28. Therefore, two alternative or similar solutions are described which may be easily chosen by the operator depending upon the particular requirements during the work. These two alternative solutions obviously may be used even when the pliers are according to the embodiment of FIGS. 1, 2, 3, and 4.

Figures 9, 10, 11:
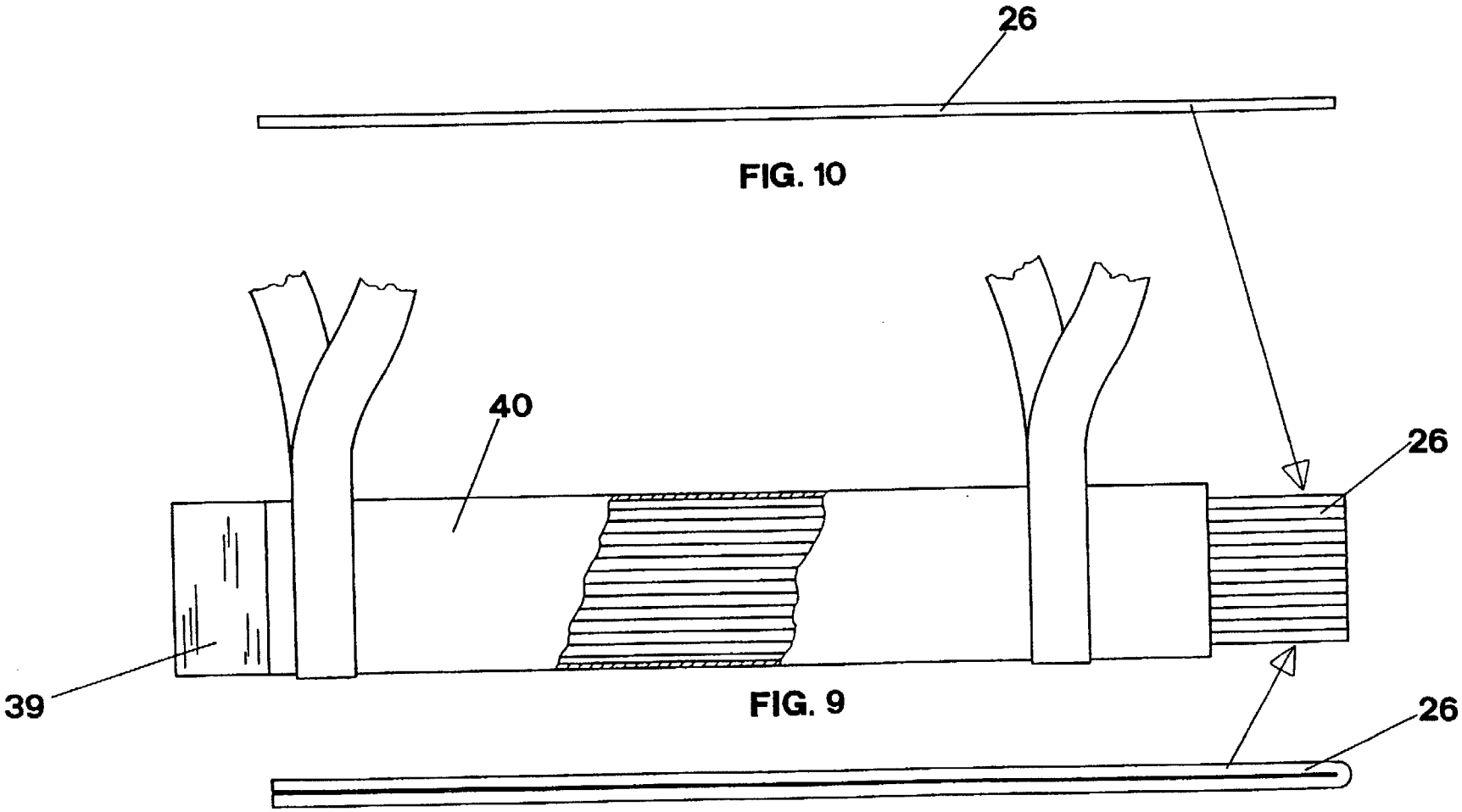
FIG. 9 shows a bundle of the fastening threads which in FIG. 10, are shown as a single thread and in FIG. 11 are shown as a double thread folded on itself.
Figure 14:
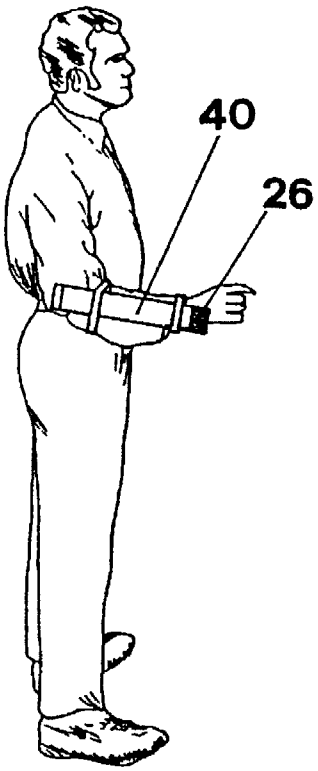
FIGS. 12, 13, 14 show three different positions of the operator and they also show that the operator may maintain the bundle of the fastening threads.
Figure 13:
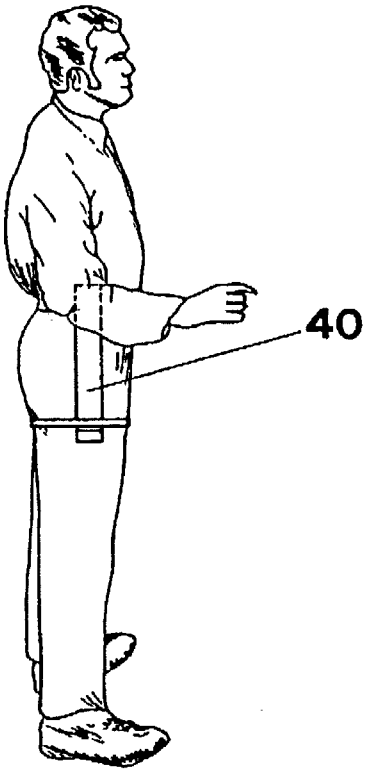
Figure 12:
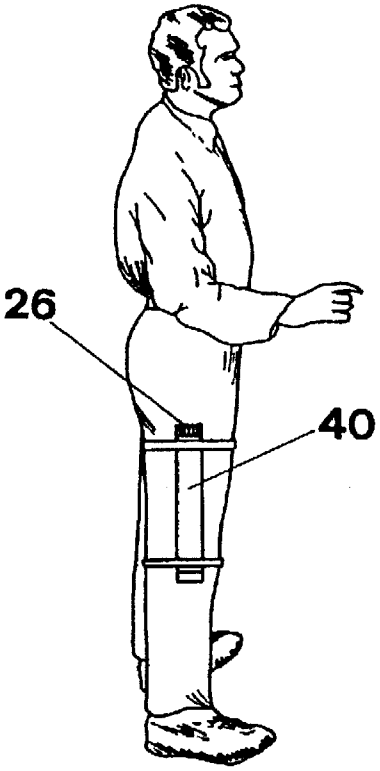

For the convenience of the operator, it is provided that the threads 26 consist of simple threads as shown in FIG. 10 or they may be constituted by a double thread as shown in FIG. 11, being about 30–60 centimeters long with a length which is lower than the length of the sleeve 23 and they are grouped in packages and they are held together by a permanent magnet 39. The latter is applied either to the bottom of the container 40 or along the body of the container itself and is applied to the body of the operator either on the leg as shown in FIG. 12, or on the central part of the body as shown in FIG. 14.

The advantages according to the rotating pliers of the present invention reside in the fact that they allow to twist and cut the fastening threads for the metallic armature to be used with concrete in the building industry without requiring the operator to rotate the pliers by hand, but simply applying a traction with longitudinal displacement of the sleeve applied on one of the arms of the pliers. The sleeve may be shaped as a spiral with substantial reduction in the physical work of the operator.

A suitable regulation of the position of the lever 11 by means of the eccentric disc 9 with the stop screw 19 which is screwed on the threaded orifices 20 allows to adapt the pliers to several diameters and different properties of the fastening thread and also to compensate for the amount of wear of the pliers themselves.

The pliers described hereinabove may also be used according to the conventional method without pulling the sleeve 3 when one wishes to vary the final position of the fastening thread 6.

The advantages of the novel feature of the embodiment of the pliers shown in FIGS. 10, 11, 12 and 13 allow the maneuvering of the pliers in rotation through the sleeve 23 while it is certain that the pliers remain closed during the operation is also obvious because it is not necessary for the operator to hold the arm 38 with his hand and it is not necessary to use the eccentric element having a regulatable position as shown in the embodiment according to FIGS. 1, 2, 3 and 4.

Obviously, the construction details of the apparatus described hereinabove and illustrated in the accompanying drawings may be varied while the essential features of the invention remain unchanged without departing from the scope of the present invention.

What is claimed is:

1. Wire twisting and cutting pliers comprising:

a) a first arm having a jaw at a first end;

b) a second arm having a jaw at a first end, said first and second arms being pivotally connected so that said jaws cooperate to form pliers to grip and cut a fastening wire for reinforcing rods;

c) an elongate screw means mounted longitudinally on one of said first and second arms and having a longitudinally moveable sleeve thereabout engaged with said screw means so as to rotate said pliers when said sleeve is moved longitudinally; and d) means for adjustably fixing the position of said jaws to grip said fastening wire therebetween during rotation of said pliers, said means comprising a plate mounted on one of said arms so as to rotate thereabout and extending towards the other of said arms and having a hook-like bend at its free end adapted to engage said other of said arms to thereby fix the position of said jaws, said plate being adjustable laterally with respect to the arm on which it is mounted so as to adjustably vary the fixed grip position of said jaws;

whereby by the lateral adjustment of said plate, varying diameter fastening wires may be fixedly gripped between the jaws of said first and second arms by rotatably moving said plate so that said bend thereof engages the other of said arms and upon completion of rotation of said pliers, continued squeezing of said arms disengages the bend of said plate from the other of said arms and causes said jaws to cut said fastening wire.

2. The wire twisting and cutting pliers as defined in claim 1, wherein the lateral adjustment of said plate with respect to the arm on which it is mounted comprises said plate including a first part and a second part, said second part being connected to said first part by means of a bolt inserted through an oblong opening for the purpose of altering the length of said plate based on the diameter of the fastening wire.

* * * * *